United States Patent [19]

Wälchli

[11] 4,245,690

[45] Jan. 20, 1981

[54] HOT CHAMBER DIE CASTING MACHINE AND METHOD FOR CONTROLLING THE FLOW OF MELT DURING AND IMMEDIATELY AFTER MOLDING A PART

[75] Inventor: Otto Wälchli, Niederuzwil, Switzerland

[73] Assignee: Gebrueder Buehler AG, Switzerland

[21] Appl. No.: 908,680

[22] Filed: May 23, 1978

[30] Foreign Application Priority Data

May 28, 1977 Sweden ..... 6547/77

[51] Int. Cl.[1] ..... B22D 17/04; B22D 17/32

[52] U.S. Cl. ..... 164/4; 164/113; 164/153; 164/154; 164/318

[58] Field of Search ..... 164/152, 153, 113, 4, 164/318, 154

[56] References Cited

U.S. PATENT DOCUMENTS

| | | | |
|---|---|---|---|
| 777,870 | 12/1904 | Vellino | 164/318 |
| 3,123,875 | 3/1964 | Madwed | 164/113 X |
| 3,270,378 | 9/1966 | Madwed | 164/318 |
| 3,474,854 | 10/1969 | Mace | 164/318 |
| 3,491,827 | 1/1970 | Mace | 164/318 |

*Primary Examiner*—R. L. Spruill
*Assistant Examiner*—J. Reed Batten, Jr.
*Attorney, Agent, or Firm*—McGlew and Tuttle

[57] ABSTRACT

A method and device for controlling the flow of molten metal of a hot chamber die casting machine from an outer surrounding melt crucible into the bore of a casting bushing which is located in the melt and which has a melt inlet opening disposed below the level of the melt in the crucible which is located upstream of a sprue runner leading to the mold cavity having a mold part maintained under closing pressure during the molding, includes a firing piston for moving a casting piston in the bore of the casting bushing so as to close the opening and to direct the melt into the mold cavity. After casting, the casting piston is moved backwardly to relieve the pressure on the mold slightly and the mold is partially opened. The casting position is locked against further movement, however, so as to prevent an inflow of the melt through the sprue runner to the mold immediately after casting.

9 Claims, 7 Drawing Figures

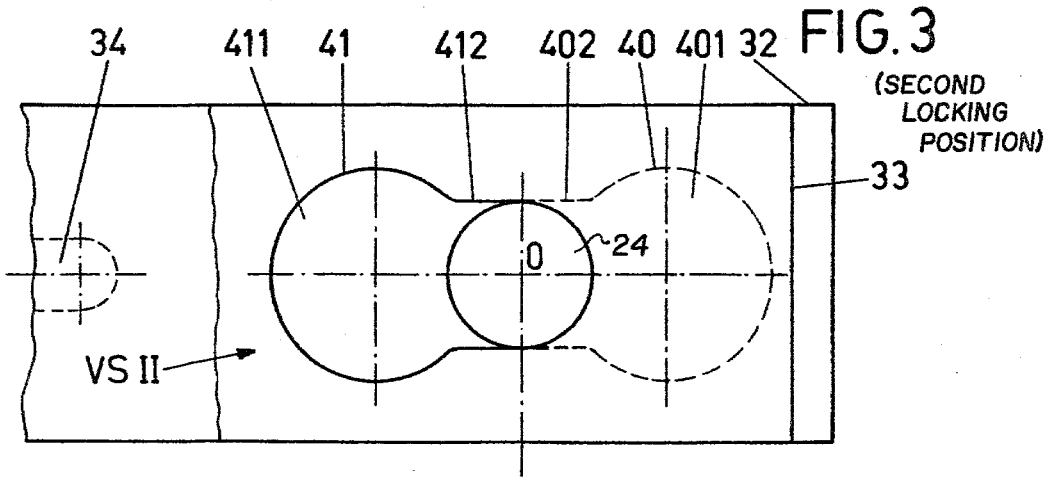
FIG. 3 (SECOND LOCKING POSITION)
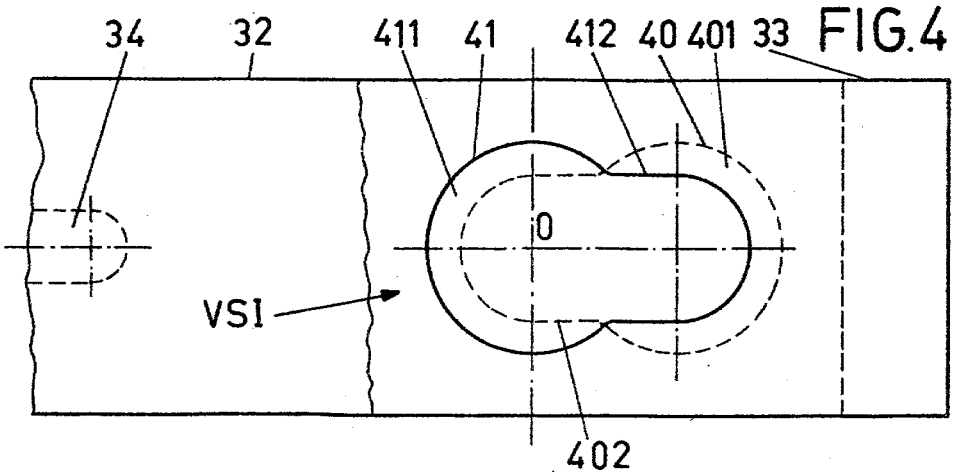
FIG. 4 (FIRST LOCKING POSITION)
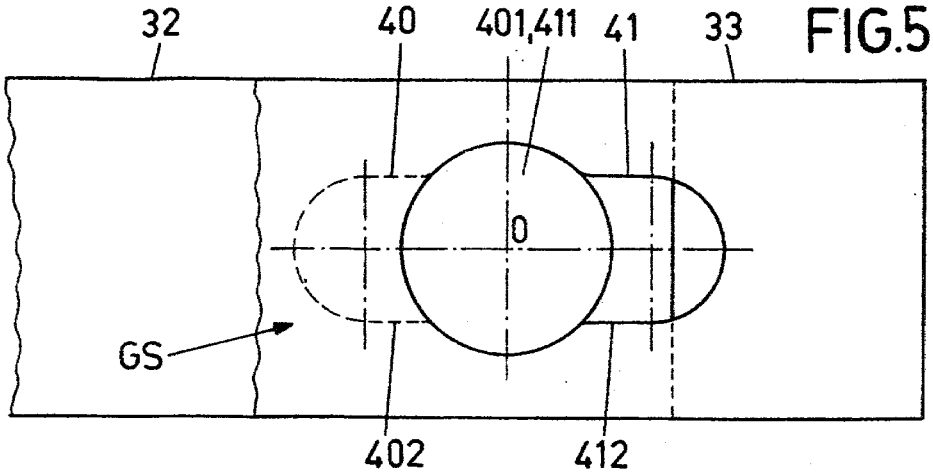
FIG. 5

HOT CHAMBER DIE CASTING MACHINE AND METHOD FOR CONTROLLING THE FLOW OF MELT DURING AND IMMEDIATELY AFTER MOLDING A PART

FIELD AND BACKGROUND OF THE INVENTION

This invention relates to casting in general and, in particular, to a new and useful safety device and method for securing the casting unit of a hot chamber die casting machine against accidental starting of the casting operation, wherein, a lock is provided which mechanically locks the pressing stroke and which is only released by the action of a mold closing pressure necessary for the casting operation.

DESCRIPTION OF THE PRIOR ART

A method is already known where the locking becomes effective at the end of the complete return stroke of the casting piston. However, securing of the casting piston in the course of a stepwise return of the piston by means of this method is not possible.

Another known method concerns the safety device acting on the inlet path of the pressure for the casting unit, which depends on the closing path of the mold and on the mold closing pressure. A disadvantage of this method is that malfunctions caused by leaks in the inlet path of the pressure are not detected.

The present invention provides a method which permits reliable prevention of any accidental movement in the firing direction after a partial return of the casting piston.

According to the invention, the locking is effected after the casting is completed by means of pressure acting in synchronism with a first step of the stepwise return of the casting piston. A casting operation started by mistake or as a result of a malfunction can be prevented positively during the further return movement of the casting piston, since the locking started at the first return step remains effective up to the time when the machine is ready for the next casting operation. It is also possible to effect the locking by a time program given by the machine control corresponding to a return of the casting piston in two steps.

The invention also concerns a safety device for carrying out the above described method, which includes a locking element cooperating with a shoulder formed on the piston rod of the casting piston and with means actuating the locking element.

Devices of the above-mentioned type have long been part of the state of the art and are used to permit the start of the casting operation only when a sufficient form-closing pressure acts on the mold. Such a known device is characterized in that a lock acting directly on the casting piston is provided which can only be released by a mechanical or hydraulic linkage when the mold is closed.

In one embodiment of this device arranged on a hot chamber die casting machine, the locking of the casting piston is effected by a distance piece on the cover plate of the smelting furnace, which is displaceable, against the force of a spring which is biased against a collar arranged on the shaft of the casting piston. The spring is dimensioned so that the distance piece can only be pushed away by means of a rod secured on the support of the ejection mold when the pressure exerted by the closing piston has attained a certain minimum value.

For a vertical cold chamber die casting machine, a second embodiment includes a shoulder formed on the casting piston rod and a pawl prestressed by a spring and bearing against the shoulder. The pawl can only be released against the spring pressure when a sufficient mold closing pressure has been attained by the casting or actuating piston. In these devices, the locking and unlocking of the casting piston is achieved with uncomplicated mechanical means in a simple and effective manner, but their use is confined to cases where the return of the casting piston takes place in a single step after the casting operation is completed.

With a complete return of the casting piston in one step and subsequent opening of the casting mold to eject the previously cast molded piece, there is a risk that the melt will be sucked out of the crucible by the resulting underpressure, over the feed opening and the casting bushing, and into the sprue opening of the fixed solid mold part. The squirting melt endangers the operating personnel and the melt solidifying in the sprue causes an interruption in the production process.

Devices have been suggested for this reason in which the return of the casting piston takes place in two steps. After the solidification of the casting, the casting piston is moved into a first position in which the feed opening, through which the melt flows from the crucible into the casting bushing, is still closed. Immediately thereafter, the casting mold is opened slightly so that the ambient air flowing into the sprue runner prevents the formation of a vacuum. After pressure equalization, the casting piston is moved into a second position in which the piston clears the feed opening, but the melt can no longer advance to the sprue opening. The mold is now completely opened and the casting is ejected.

It is also known to provide a safety circuit in a horizontal cold chamber die casting machine as a lock for the control valve for controlling a hydraulic pressure cylinder driving the casting piston. Accidental starting of the casting operation cannot be positively prevented, however, since such a device does not ensure that the control valve cannot become inoperative, for example, by leakage of the valve.

SUMMARY OF THE INVENTION

The present invention provides a device which ensures the great reliability of a mechanical lock in a hot chamber die casting machine with stepwise return of the casting piston.

The device includes a two part locking element whose parts each have a recess for the piston rod of the casting piston and are arranged in series along the piston rod so that at least one of the two parts is displaceable relative to the other, with at least one component directed perpendicularly to the direction of displacement of the casting piston which can be brought into engagement with the shoulder of the piston rod in at least two fixed locking positions at a predetermined spacing from each other in the direction of displacement.

These measures permit the desired objective, since the path of the casting piston is already blocked in a firing direction starting from a temporary intermediate position of its stepwise return after the completed casting operation. The blocking action of the locking element cannot be offset by the elimination of the pressure necessary for the relative movement of its parts. It can only be offset by an interference signal in agreement with the renewed closing of the mold by means of the closing pressure required for the casting operation.

According to a preferred embodiment of the safety device of the invention, the locking element is advantageously composed of two displaceable plates sliding on one another, each with a keyhole bore for the passage of the casting piston. Preferably, the bores each have a larger circular part whose diameter corresponds to that of the piston rod, and an oblong constriction whose width is equal to the diameter of a segment offset to form the shoulder on the piston rod. The oblong constrictions of the two bores advantageously extend in opposite directions.

It is advisable to connect one plate rigidly with the cylinder and the other plate with the piston of a freely moving pressure drive, so that the keyhole bores can be displaced one above the other together with the plates, due to the relative movement of piston and cylinder, and, depending on the pressure admission, one of the pressure chambers of the cylinder can be set in three predetermined mutual relative positions. In a first relative position, namely, the first locking position corresponding to the first step of the return stroke of the casting piston, the shoulder of the piston rod can be retained at the constriction of the keyhole bore of the plate at the piston end.

In a second relative position, namely, the second locking position corresponding to the full return stroke of the casting piston, the same shoulder can be brought into engagement with the constriction of the keyhole bore of the plate remote of the casting piston.

Finally, in a third relative position, namely, the casting position, the passage of the casting piston in the firing position is made possible by the aligned circular parts of the bores. In this position, it may be advisable to limit the movement of the two plates by furnishing each with a stop.

According to another embodiment of the invention, the locking element may advantageously be composed of two wedgeshaped plates in the longitudinal section, which in a top view, each have a U-shaped recess for the piston rod. It is advisable to make the recess of the fixed plate facing the casting piston equal to the diameter of the solid piston rod, and to adapt the recess of the plate remote of the casting piston and displaceable along the common inclined surface of the two plates to the diameter of the offset segment of the piston rod.

The plate remote of the casting piston should preferably be rigidly connected at one end with the piston of a pressure drive and, at the other end, with a restoring spring, so that it can be displaced with it along the common inclined surface of the two plates in both directions and is constantly in engagement with the shoulder of the piston rod between two relative positions of the two plates, corresponding to the first step of the return stroke of the casting piston and the full return stroke.

Accordingly, it is an object of the invention to provide a method for controlling the flow of molten metal of a hot chamber die casting machine from an outer surrounding melt crucible into the bore of a casting bushing which is located in the melt and has a melt inlet opening disposed below the level of the melt and which bushing also has a sprue runner leading into the mold cavity defined between two interengageable mold parts which may be held closed by a pressure-applying piston and which further includes a casting piston which is movable in the bore of the casting bushing to advance the melt and which may close or open the inlet in accordance with whether the piston is in alignment therewith and which comprises driving the piston in the bore from a casting position in which it is located above the opening and thus permits the inflow of the melt into the bore by applying pressure to the piston in a first direction to drive it in the bore to close the opening and move the melt ahead of the piston into the mold cavity while the mold parts are maintained in a closed position and under a closing pressure for the molding of the article, applying a pressure to the piston in an opposite second direction to move it backwardly away from the mold cavity to relieve the pressure thereon but not sufficient to open the inlet opening, locking the piston against further movement until the mold pressure increases to a predetermined value, and thereafter, unlocking the piston and driving the piston backwardly to an original casting position in which it clears the opening.

A further object of the invention is to provide a casting device which comprises a fixed mold part and a movable mold part which is engageable therewith and which together define a mold cavity therebetween and including means for moving the molds relative to each other and to hold the molds in closing engagement under pressure and further including a melt crucible with a casting bushing disposed in the crucible and adapted to be positioned below the melt level therein and having a cylinder bore with a side inlet defining a feed opening extending below the melt level which is closable by a casting piston which is movable in the bore to displace the melt therein after closing the opening, the bore being provided with a sprue runner portion following the opening which discharges into the mold cavity and further including drive means for driving the casting piston and safety means for locking the piston to stop the movement thereof after it is moved in the bore to close the opening and force the melt into the cavity and to prevent it from moving backwardly sufficiently to reopen the inlet.

Another object of the invention is to provide a casting device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 3 is a top view of the plates of the locking element according to FIG. 1 with the firing cylinder removed, wherein the relative position of the keyhole bores in the plates corresponds to the locking position according to FIG. 2;

FIG. 4 is a top view, similar to FIG. 3, but wherein the relative position of the keyhole bores corresponds to the locking position after a first step of the return stroke of the casting piston;

FIG. 5 is a top view, similar to FIGS. 3 and 4, illustrating the relative position of the keyhole bores which permits the passage of the piston rod;

DESCRIPTION OF THE PREFERRED EMBODIMENTS

Figure 1:
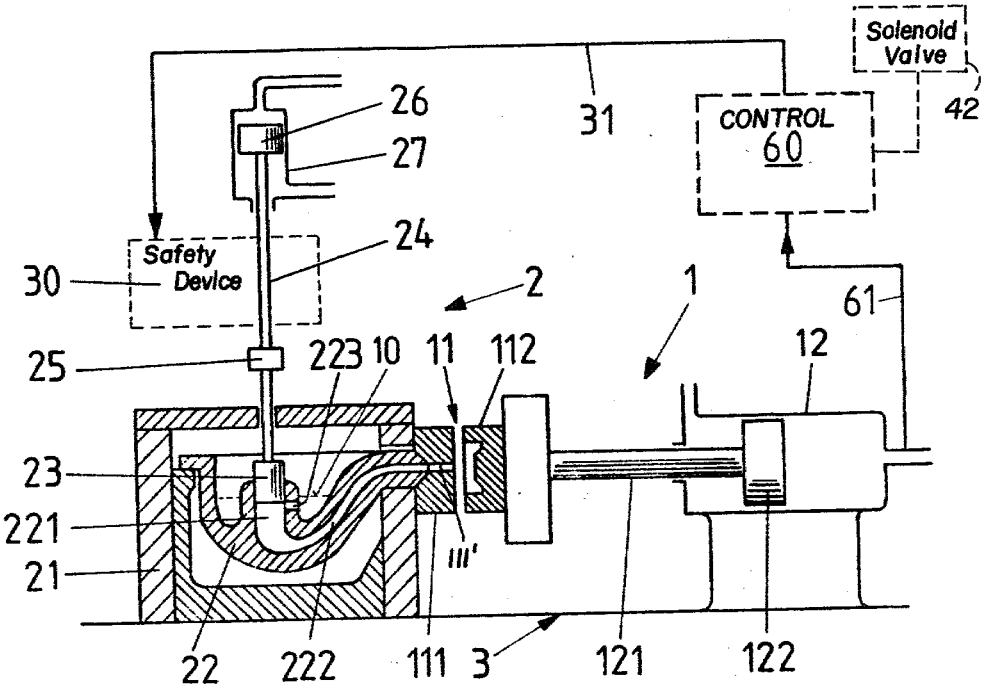
FIG. 1 is a longitudinal sectional view of a hot chamber die casting machine with a safety device for the casting piston arranged thereon, constructed in accordance with the invention, and indicated schematically by broken lines.

Referring to the drawings in particular, the invention embodied therein, comprises, a method and device for securing a casting unit of a hot chamber die casting machine against accidental start of the casting operation. According to the invention, the machine includes a molding press portion 1 and a casting unit 2 arranged on a common frame 3. Molding press 1 comprises a two-part mold 11 and a mold-closing cylinder 12. A first fixed mold part 111 on the gate or spure side of mold 11 is rigidly connected with the casting unit 2, while a moving mold part 112 is in direct connection with a pressure piston 122 of mold closing cylinder 12 by means of a piston rod 121.

Casting unit 2 has a crucible 21 in which is disposed a casting bushing 22. A metal bath level 10 is maintained over bushing 22. The casting bushing 22 has a cylinder bore 221 extending vertically, and a sprue runner 222 connects the bore with a bore 111' on the fixed mold part 111, as well as metal feed opening 223 provided in the wall of the cylinder bore 221. A casting piston 23 is displaceably mounted in the cylinder bore 221 of the casting bushing 22. The casting piston 23 is rigidly connected by means of a two-part piston rod 24 and connecting coupling 25 to a pressure piston 26 which is a so-called firing piston. The piston 26 moves in a so-called firing cylinder 27.

A rectangle, represented by broken lines, surrounding piston rod 24 indicates a safety device 30 acting on the rod. This safety device 30 is in operative connection over a line 31 with a machine control 60 which is indicated by another rectangle represented in broken lines. A pressure measuring line 61 leads from the pressure chamber of mold closing cylinder 12 associated with the solid pressure surface of the pressure piston 122 into machine control 60. In the position of casting piston 23, shown in FIg. 1, the melt from the interior of crucible 21 can fill casting bushing 22 via the feed opening 223, so that casting unit 2 is ready for a casting operation.

During this time, safety device 30 retains casting piston 23 by means of piston rod 24, so that a start of the casting operation by pressure admission of firing piston 26 caused by a mistake or by a defect in the hydraulic circuit before the closing of mold 11 with the technologically required mold closing pressure is not possible. If the necessary or operational pressure is reported after the closing of the mold, over the measuring line 61 to machine control 60, the control causes the release of safety device 30 over line 31, and the safety device 30 releases the piston 23 and permits the execution of the casting operation.

When mold 11 is opened to remove a solidified molded piece, the return of the casting piston 23 takes place in two steps. First, casting piston 23 is moved into a first return position in which metal feed opening 223 remains closed, and then, mold 11 is slightly opened. The object of this measure is to prevent the liquid metal, which is sucked by underpressure which occurs during the opening of the mold, from moving from the crucible 21 through the feed opening 223 and casting bushing 22, out through the sprue opening of the stationary half 111 of casting mold 11, which would cause a breakdown, in addition to endangering the operating personnel.

Casting piston 23 is returned to the end position, according to FIG. 1, after pressure equalization has been obtained in its intermediate position, with casting bushing 22 being filled with the melt without the melt squirting out from sprue runner 222, so that the machine can be prepared for the following casting operation. According to the invention, safety device 30, induced by machine control 60, locks casting piston 23 and its piston rod 24 against any accidental movement into casting bushing 22 from the time it reaches the first return position of casting piston 23 until it is released by machine control 60 when the die casting machine is ready to fire.

In the embodiment of the safety device 30 described below, a two-part locking element is provided, whose parts are arranged in series along piston rod 24 of casting piston 23. They cooperate in the course of the relative movement with at least one component directly perpendicular to the direction of displacement of casting piston 23, with a shoulder 241 formed on piston rod 24 (see FIGS. 2 and 6).

Figure 2:
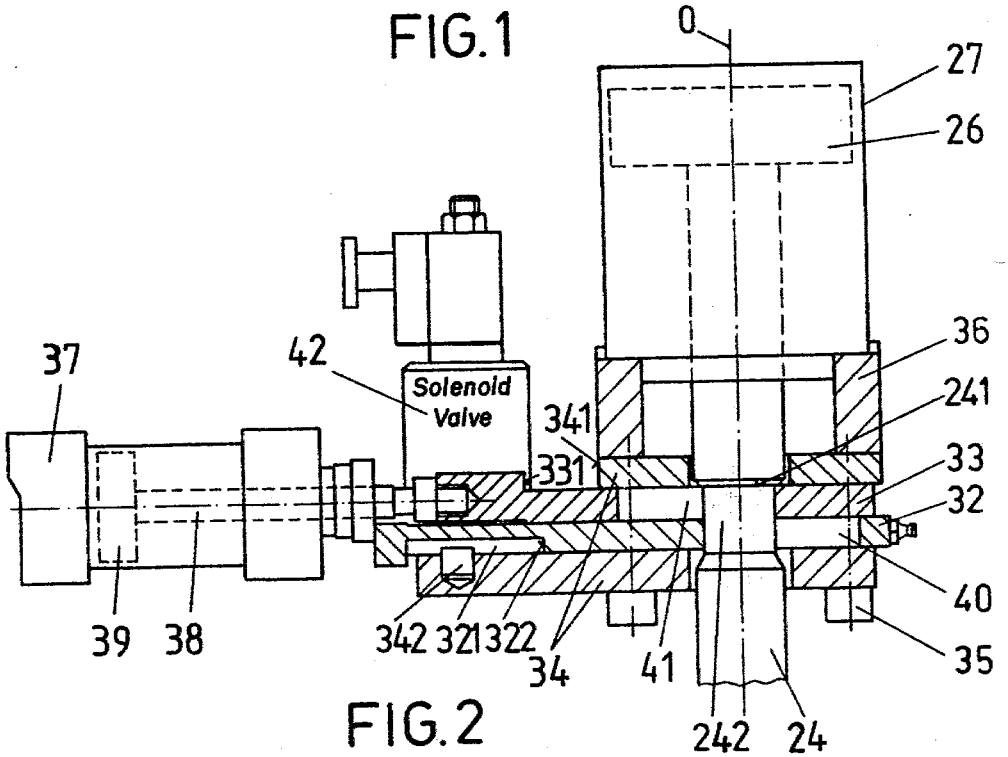
FIG. 2 is a front view, partly in section, of a locking control of the invention wherein the piston rod of the casting piston is locked in its end position during the return.

A first embodiment of safety device 30 is shown in FIGS. 2 to 5 and, as indicated in FIG. 2, it comprises two displaceable plates 32 and 33 sliding on each other, which are guided in a housing 34 which is rigidly connected with firing cylinder 27 by means of screw bolts 35 over a yoke 36. The bottom plate 32 is rigidly connected with a freely moving driving cylinder 37 and the top plate 33 is connected through a piston rod 38 with the respective driving piston 39. The plates 32 and 33 have each a keyhole bore 40 and 41, respectively, for the passage of piston rod 24 of casting piston 23 (see also FIGS. 3 to 5).

The diameter of larger circular bore parts 401, 411 corresponds to, or is greater than that of piston rod 24 of casting piston 23, and the width of the oblong constrictions 402, 412 to the diameter of a reduced diameter portion or piston rod-segment 242 (shown only in FIG. 2) and which is offset to form shoulder 241 on this piston rod 24. As can be seen from FIGS. 3 to 5, the constrictions 412 of plate 33 and 402 of plate 32 are oppositely directed.

In FIG. 3, the plates 32 and 33 are in a relative position of their keyhole bores 40 and 41, which corresponds to the so-called second locking position, designated VS II after the full return of the casting piston. Constrictions 402 and 412 of keyhole bores 40 and 41, respectively, embrace the offset segment 242 of piston rod 24, and shoulder 241 engages top plate 33. A movement of casting piston 23 in the direction of the casting bushing 22 is not possible.

In FIG. 4, the plates 32 and 33 are shown in another relative position of their keyhole bores 40 and 41 corresponding to the so-called first locking position VS I after a first step of the return stroke of the casting piston. In this position, the bottom plate 32 is with its keyhole bore 40 relative to axis O of piston rod 24 in the same position as in FIG. 3. However, top plate 33 is displaced to the right with its keyhole bore 41 relative to said axis O, so that shoulder 241 of piston rod 24 merely bears against plate 32 and is retained at its constriction. The locking of casting piston 23 thus takes place in a position which is at a distance from the above-described second locking postion VS II corresponding to the thickness of top plate 33.

FIG. 5 shows the two plates 32 and 33 in a third relative position of their keyhole bores 40, 41 corresponding to the so-called casting position GS. After a displacement of bottom plate 32 to the left relative to axis O of piston rod 24, the circular bore parts 401, 411 of the keyhole bores 40, 41 are concentric to piston rod 24 and permit its passage in the direction of casting bushing 22.

In the casting position, designated GS, shown in FIG. 5, a lug 331 of top plate 33 strikes against a stop surface 341 formed on the upper part of housing 34, and a stop pin 342 secured in the bottom part of housing 34 strikes against a stop surface 322 formed in bottom plate 32 at the end of a groove 321 extending in its direction of motion. The movement of top plate 33 is thus limited to the right, and that of bottom plate 32 to the left, see FIG. 2, in order to ensure exact centering of the circular bore parts 401, 411 of the keyhole bores 40, 41 relative to axis O of piston rods 24, so that the latter can pass unhindered to perform the casting operation.

The pressure admission of driving cylinder 37 is controlled by means of a solenoid valve 42 according to a time program given by machine control 60 for the locking to be effected simultaneously with the stepwise return of the casting piston, which also includes the mold closing pressure required for releasing the safety device. The demands made on the safety device can thus be met, namely, that the casting piston is first released for the pressing stroke by the mold closing pressure required for the casting operation, and that the locking takes place corresponding to the return of the casting piston in two steps, namely, according to a stroketime gradient determined as required.

During the return, piston rod 24 is thus first retained together with casting piston 23 in the first locking position VS I, in which metal feed opening 223 is still covered, as shown in FIG. 1, and then in the second locking position VS II, in which metal feed opening 223 is cleared. They then remain in this second position until the plates 32 and 33 assume their casting position GS.

Figure 6:
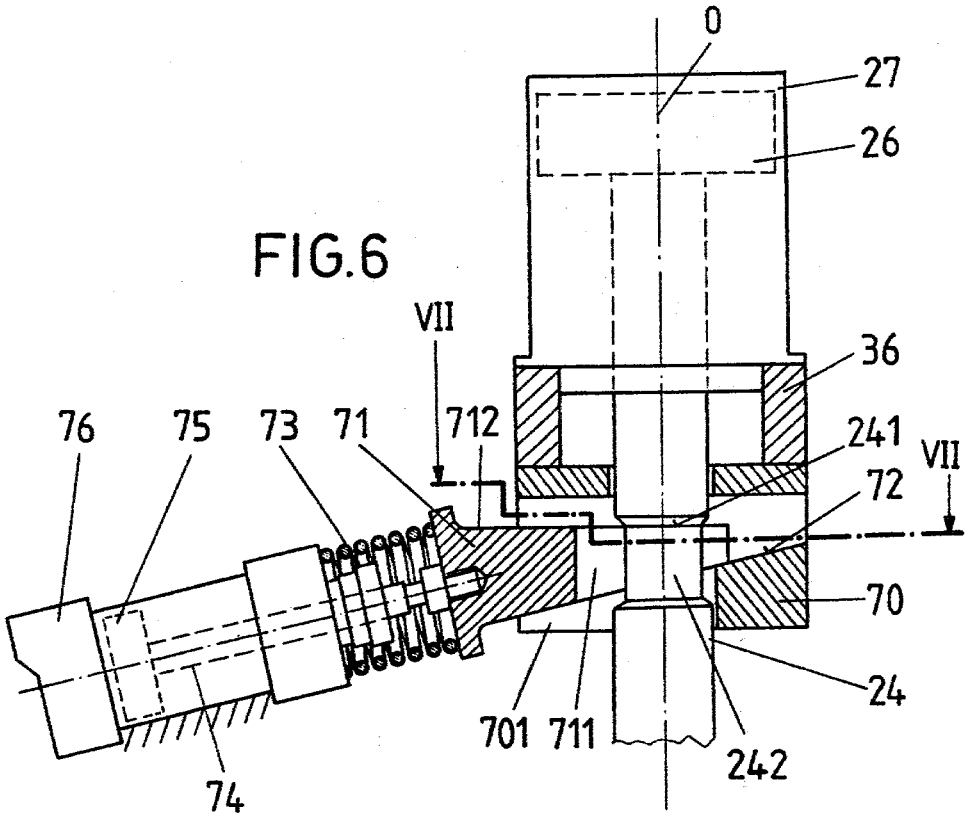
FIG. 6 is a front elevational view, partly in section, of another embodiment of the invention, with a portion of the casting unit in the locking position, corresponding to the first step of the return stroke of the casting piston.
Figure 7:
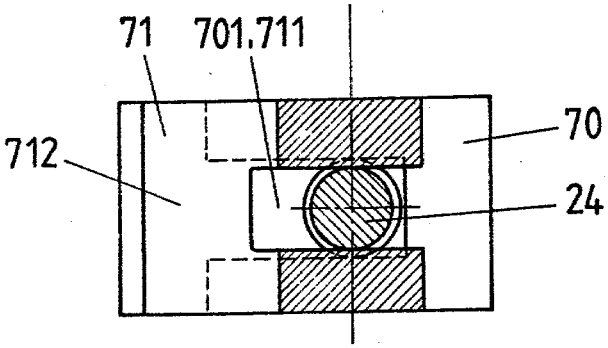
FIG. 7 is a section through the safety device, according to FIG. 6, along line VII—VII.

In a second embodiment of the safety device 30, according to the invention, as shown in FIGS. 6 and 7, the locking element has two wedge-shaped plates 70 and 71 in respect to a longitudinal section. The plate 71 is slidingly displaceable along the common inclined surface 72 of the two plates 70 and 71. The bottom plate 70 is rigidly connected with yoke 36 and has a U-shaped recess 701, seen from the top, whose width corresponds to the diameter of the solid piston rod 24. However, recess 701 may also be a cylindrical bore.

Likewise, in top plate 71, a U-shaped recess 711 with a width adapted to the diameter of the offset segment 242 of piston rod 24 is provided. Top plate 71 is rigidly connected with a restoring spring 73 and by means of a piston rod 74 with driving piston 75 of a stationary driving cylinder 76, the direction of displacement of driving piston 75 being parallel to the common inclined surface 72 of the two plates 70 and 71.

The two wedge-shaped plates 70 and 71 are so dimensioned that top plate 71 is pushed with the two sides of its horizontally extending U-shaped surface 712 through restoring spring 73 under shoulder 241 of piston rod 24 of casting piston 23 at the time when the casting piston 23 just arrives in the first locking position VS I during its return. FIG. 6 shows this position.

FIG. 7 shows the same position of the device in a top view, wherein the parts above the sectional plane VII—VII indicated in FIG. 6 have been removed.

Under the action of restoring spring 73, top plate 71 remains constantly in engagement with shoulder 241 of its piston rod 24 in the course of the following further return of casting piston 23 until the second locking position VS II is reached.

The distance of the two locking positions VS I, VS II is, in this case, given by the slope of the common inclined surface 72 of the two plates 70 and 71, and the depth of the U-shaped recess 711 of top plate 71.

A time program for the stepwise locking is unnecessary in this arrangement. The locking is furthermore ensured under all circumstances independent of any failure of the control pressure for driving cylinder 76. The control pressure is merely determined in order to return top plate 71 from the range of motion of piston rod 24 in the presence of the required mold closing pressure, and thus to start the casting operation.

While specific embodiments of the invention have been shown and described in detail to illustrate the application of the principles of the invention, it will be understood that the invention may be embodied otherwise without departing from such principles.

What is claimed is:

1. A method for controlling the flow of molten metal of a hot chamber die casting machine from an outer surrounding metal crucible into the bore of a casting bushing which is located in the melt and has a melt inlet opening disposed below the level of the melt in the crucible and a sprue runner leading from the bore to a mold cavity defined between two mold parts and which also includes a casting piston which is movable in the bore to advance the melt and which has a side surface alignable with the inlet opening to close it, comprising, driving the casting piston in a first direction from an original casting position in which it is located above the opening and thus permits the inflow of melt into the bore so that it moves along the bore to close the opening and beyond the opening to advance the melt into the mold cavity while the mold parts are maintained in closed relationship by applying a closing pressure thereto, moving the piston after the solidification of the casting in an opposite second direction backwardly away from the mold by an amount sufficient to relieve only a small quantity of the pressure acting on the mold cavity but not sufficient to open the opening to the melt, locking the piston against movement in said first direction, and thereafter moving the piston back to the original casting position in which it clears the opening while maintaining the locking of the piston against movement in said first direction until the closing pressure reaches a predetermined value indicating that the two mold parts are maintained in closed relationship and then releasing the locking of the piston in the first direction when the closing pressure reaches the predetermined value.

2. A method as claimed in claim 1, wherein the casting piston is moved to a first locking position in which the piston is moved backwardly from the mold cavity by a predetermined amount and, thereafter, to a second locking position in which the piston is moved a further amount and the feed opening is opened.

3. A casting device, comprising, a fixed mold part, a movable mold part engageable with the fixed mold part to enclose a mold cavity, mold moving means connected to said movable mold part to move it into and out of engagement with said fixed mold part and to apply pressure thereto to maintain said movable mold part in engagement with said fixed mold part, a melt crucible, a casting bushing disposed in said melt crucible and adapted to be positioned below a melt level therein, said casting bushing having a cylindrical bore with a side inlet defining a feed opening extending below the melt level into said bore, a casting piston movable in said bore to displace the melt therein and being alignable with said inlet to close it, said bore having a sprue runner following the opening discharging into the mold cavity, drive means for driving said casting piston to first move it into said bore to displace the melt therein and then retract it from said bore to a first position with said casting piston covering said side inlet and to a second position further retracting said casting piston from said bore with said casting piston away from said side inlet, safety locking means engageable with said casting piston to prevent it from movement into said bore to displace the melt therein when said casting piston is in said first position and when said casting piston is in said second position until said mold moving means applies said pressure to said movable mold part to maintain said movable mold part in engagement with said fixed mold part, and control means operatively connecting the safety locking means to a measuring line of the mold moving means, the control means causing the safety locking means to release the casting piston when the measuring line indicates that the pressure applied to said movable mold part is sufficient to maintain said movable mold part in engagement with said fixed mold part.

4. A casting device, according to claim 3, wherein said safety locking means comprises two locking members each having a recess therethrough, said casting piston including a piston rod having a small diameter portion and a shoulder portion, said small diameter portion movable through said recesses of said two locking members, said locking members arranged in series along the path of movement of said piston rod so that at least one of said two parts is movable relative to the other and at an angle to the movement of said piston rod to move into engagement with said shoulder portion in at least two locking positions to prevent movement of said casting piston into said bore when said casting piston is in said first and second positions.

5. A casting device, comprising, a fixed mold part, a movable mold part engageable with the fixed mold part to enclose a mold cavity, mold moving means connected to said movable mold part to move it into and out of engagement with said fixed mold part and to apply pressure thereto to maintain said movable mold part in engagement with said fixed mold part, a melt crucible, a casting bushing disposed in said melt crucible and adapted to be positioned below the melt level therein, said casting bushing having a cylindrical bore with a side inlet defining a feed opening extending below the melt level into said bore, a casting piston movable in said bore to displace the melt therein and being alignable with said inlet to close said inlet, said bore having a sprue runner following the opening discharging into the mold cavity, drive means for driving said casting piston, and safety locking means engageable with said piston to prevent said piston from an unintended or accidental restarting of the casting stroke, outgoing from an intermediate locking position of its stepwise return stroke after a completed mold filling cycle, until renewed closing of the mold is effected by means of the closing pressure required for the die casting operation, said safety locking means comprising a two-part locking element whose parts each have a recess for a piston rod of the casting piston and are arranged in series along the piston rod so that at least one of the two parts is displaceable relative to the other, the piston rod having a shoulder, with at least one of said parts having a component of displacement directed perpendicularly to the direction of displacement of the casting piston, which can be brought into engagement with the shoulder of the piston rod in at least two fixed locking positions at a predetermined spacing from each other in the direction of displacement.

6. A casting device, as claimed in claim 5, wherein said two parts comprise first and second plate members having keyhole slots therein extending in respective opposite directions, said plates being displaceable in respective opposite directions for aligning the portions of the keyhole slots of each plate, each keyhole slot including a wide diameter portion and a smaller diameter portion, said piston rod having a small diameter portion engageable in the keyhole slot of said first and second plates and a large diameter portion forming said shoulder, of a size to pass through the large diameter portion of the keyhole slot but being too large to pass through the small diameter portion thereof, and means for shifting said plates to selectively align the large and small diameter portions in respect to the small diameter portion of said piston rod.

7. A casting device, as claimed in claim 6, wherein said small diameter portion of said piston rod aligns with said first and second plates in the keyhole slots thereof when said piston rod moves in a casting direction toward said sprue runner beyond the position at which the casting piston closes said inlet.

8. A casting device, comprising, a fixed mold part, a movable mold part engageable with the fixed mold part to enclose a mold cavity, mold moving means connected to said movable part to move it into and out of engagement with said fixed mold part and to apply pressure thereto to maintain said movable mold part in engagement with said fixed mold part, a melt crucible, a casting bushing disposed in said melt crucible and adapted to be positioned below the melt level therein, said casting bushing having a cylindrical bore with a side inlet defining a feed opening extending below the melt level into said bore, a casting piston movable in said bore to displace the melt therein and being alignable with said inlet to close said inlet, said bore having a sprue runner following the opening discharging into the mold cavity, drive means for driving said casting piston, and safety locking means engageable with said piston to prevent said piston from an unintended or accidental restarting of the casting stroke, outgoing from an intermediate locking position of its stepwise return stroke after a completed mold filling cycle, until renewed closing of the mold is effected by means of the closing pressure required for the die casting operation, a piston rod connected to said casting piston and piston and cylinder means connected to said piston rod for moving said piston rod and said casting piston, said safety locking means comprising a member having a slot therethrough for the passage of the piston rod therethrough, and having a cross slot bounded by a surface which has a bevel therein, a forked bevel locking member slidable on said surface and having an opening therethrough for the passage of said piston rod, said piston rod including a small diameter portion and a large diameter portion on each side of said small diameter portion, said forked locking member being engageable in said small diameter portion and being advanceable to move into locking engagement against said large diameter portion bounding said small diameter portion so as to prevent further movement of said casting piston in a casting direction.

9. A casting device, as claimed in claim 8, including spring means urging said forked member into engagement with said piston rod.

* * * * *